United States Patent [19]

Herr et al.

[11] 4,164,192

[45] Aug. 14, 1979

[54] SEWING MACHINE MOTOR SPEED LIMITING BY PATTERN SELECTION

[75] Inventors: John A. Herr, Garwood; Jack Brown, Union; Wesley R. Peterson, Bound Brook; Wolfgang Jaffe, Roselle Park, all of N.J.

[73] Assignee: The Singer Company, New York, N.Y.

[21] Appl. No.: 965,220

[22] Filed: Nov. 30, 1978

[51] Int. Cl.[2] ..... D05B 3/02; D05B 69/18

[52] U.S. Cl. ..... 112/158 E; 112/220; 318/305; 318/342; 318/348

[58] Field of Search ..... 112/158 E, 220, 221, 112/275, 277, 153, 121.11, 121.12; 318/305, 163, 342, 348, 569, 571

[56] References Cited

U.S. PATENT DOCUMENTS

| | | | |
|---|---|---|---|
| 3,780,681 | 12/1973 | Sasaki | 112/275 |
| 3,913,507 | 10/1975 | Pollmeier | 112/153 |
| 4,108,093 | 8/1978 | Watanabe et al. | 112/158 E |

*Primary Examiner*—Peter Nerbun

*Attorney, Agent, or Firm*—Michael H. Wallach; Robert E. Smith; Edward L. Bell

[57] ABSTRACT

A circuit which limits the maximum permissible speed of a sewing machine motor when specific stitch patterns are selected. Electronic signals from a means for sensing the selected stitch pattern are analyzed by the circuit to control the operation of a relay which connects a resistance in series with the sewing machine motor to reduce the maximum speed at which the drive motor may be operated.

5 Claims, 4 Drawing Figures

SEWING MACHINE MOTOR SPEED LIMITING BY PATTERN SELECTION

BACKGROUND OF THE INVENTION

1. Field of the Invention

This invention relates to sewing machines in general and more particularly to sewing machines having preprogrammed stitch patterns and electronic means for selectively controlling the stitch forming instrumentalities to produce a selected stitch pattern.

2. Description of the Prior Art

It will be appreciated by one skilled in the art of sewing that it is advantageous to limit the maximum sewing speed during the formation of certain intricate stitches to minimize the possibility of poorly formed stitches. Some prior known electronic sewing machines have heretofore stored motor speed information with pattern information in an electronic memory. Such machines have required additional complex electronic components to decode the motor speed information and use it to limit the speed of the sewing machine motor.

One problem associated with some prior known sewing machines having electronically controlled stitch forming instrumentalities is that they did not automatically limit the maximum motor speed during the formation of certain stitches and were thus subject to improper stitch formation.

Another problem is that sewing machines which stored speed information in an electronic memory required complex electronic circuits to decode the information and control the sewing machine drive motor.

Another problem is that the operator was required to remember which stitches should not be sewn at the maximum motor speed on sewing machines in which the speed information was not stored in an electronic memory.

Still another problem is that an operator could accidentally depress the foot controller and operate the sewing machine at a higher-than-desirable motor speed while sewing intricate stitches.

SUMMARY OF THE INVENTION

One object of this invention is to provide an electronic circuit which will automatically reduce the maximum speed at which a sewing machine motor may operate upon the selection of specific stitch patterns.

It is another object to provide an electronic motor speed control circuit which will not affect the maximum speed at which a sewing machine motor may be operated.

Still another object is to automatically reduce the maximum motor speed as a result of selecting specific stitch patterns.

The above objects and other advantages are achieved by an electronic circuit which is supplied with electronic signals from an operator influenced pattern selector means and selectively operates a relay when specific stitch patterns have been selected. The operation of the relay switches a speed limiting resistor into the motor speed control circuit, thereby limiting the maximum speed at which the motor will operate. The speed limiting resistor is removed from the circuit upon the selection of a stitch pattern not requiring motor speed limiting, thereby permitting the sewing machine drive motor to be operated at the maximum speed allowed by the motor speed control circuit.

BRIEF DESCRIPTION OF THE DRAWINGS

The above and other objects of this invention will be evident from an understanding of the preferred embodiment which is hereinafter set forth in such detail as to enable those skilled in the art to readily understand the function, operation, construction and advantages of it when read in conjunction with the accompanying drawings in which.

DESCRIPTION OF THE PREFERRED EMBODIMENT

Figure 1:
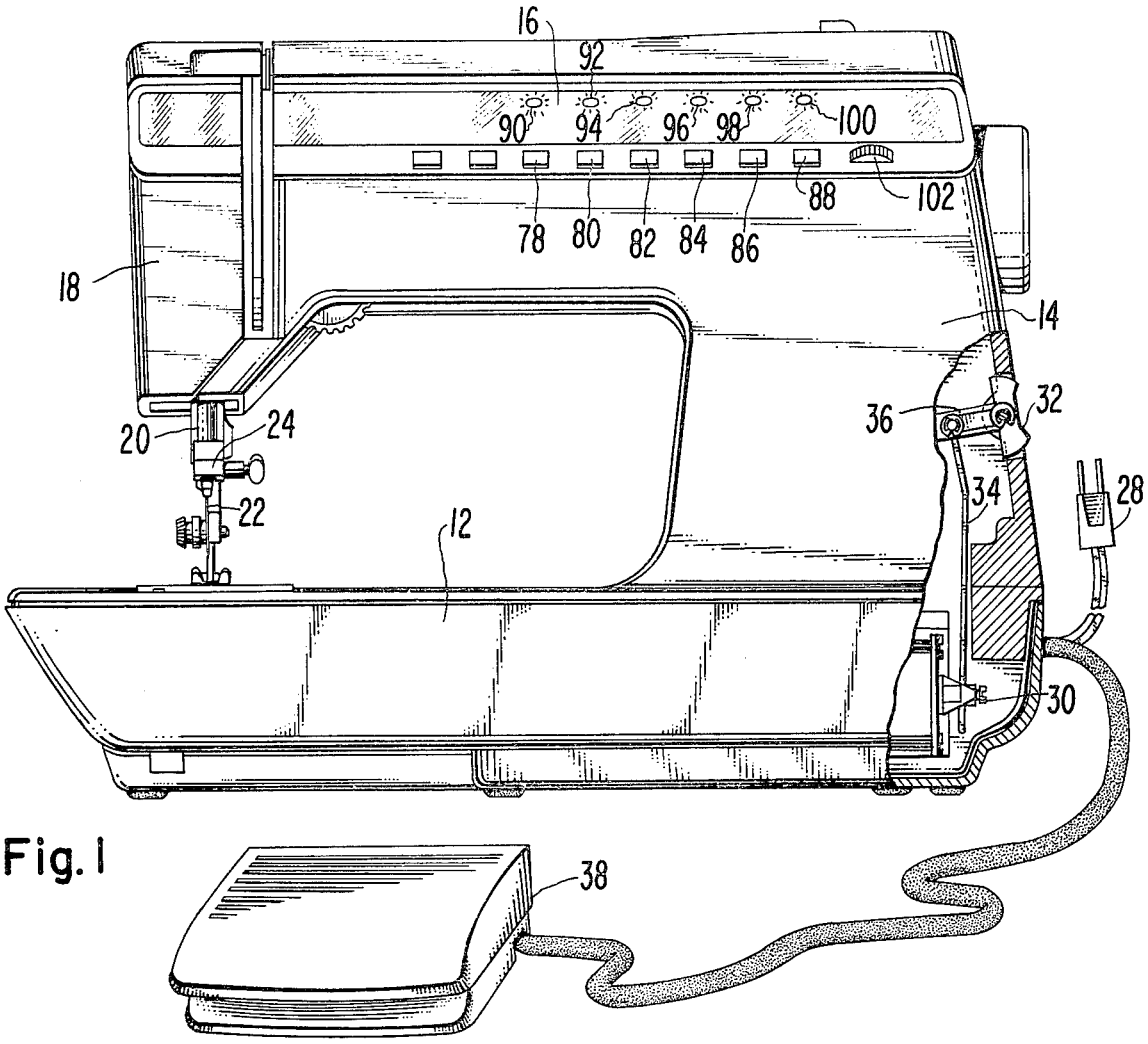
FIG. 1 is a cutaway perspective view of a sewing machine having an electronic pattern selection means and showing a means for mechanically influencing a motor speed selector switch.

Referring to the drawings, FIG. 1 shows a zig zag sewing machine of a type in which the stitch forming instrumentalities may be controlled by electronic means. One type of zig zag sewing machine having electronic means for selectively controlling the stitch forming instrumentalities to which the presently disclosed invention may be advantageously applied is disclosed in U.S. Pat. No. 3,872,808 which issued to J. W. Wurst on Mar. 25, 1975, the rights to which are owned by the assignee of the present invention and the teachings of which are incorporated herein by reference.

Figure 2:
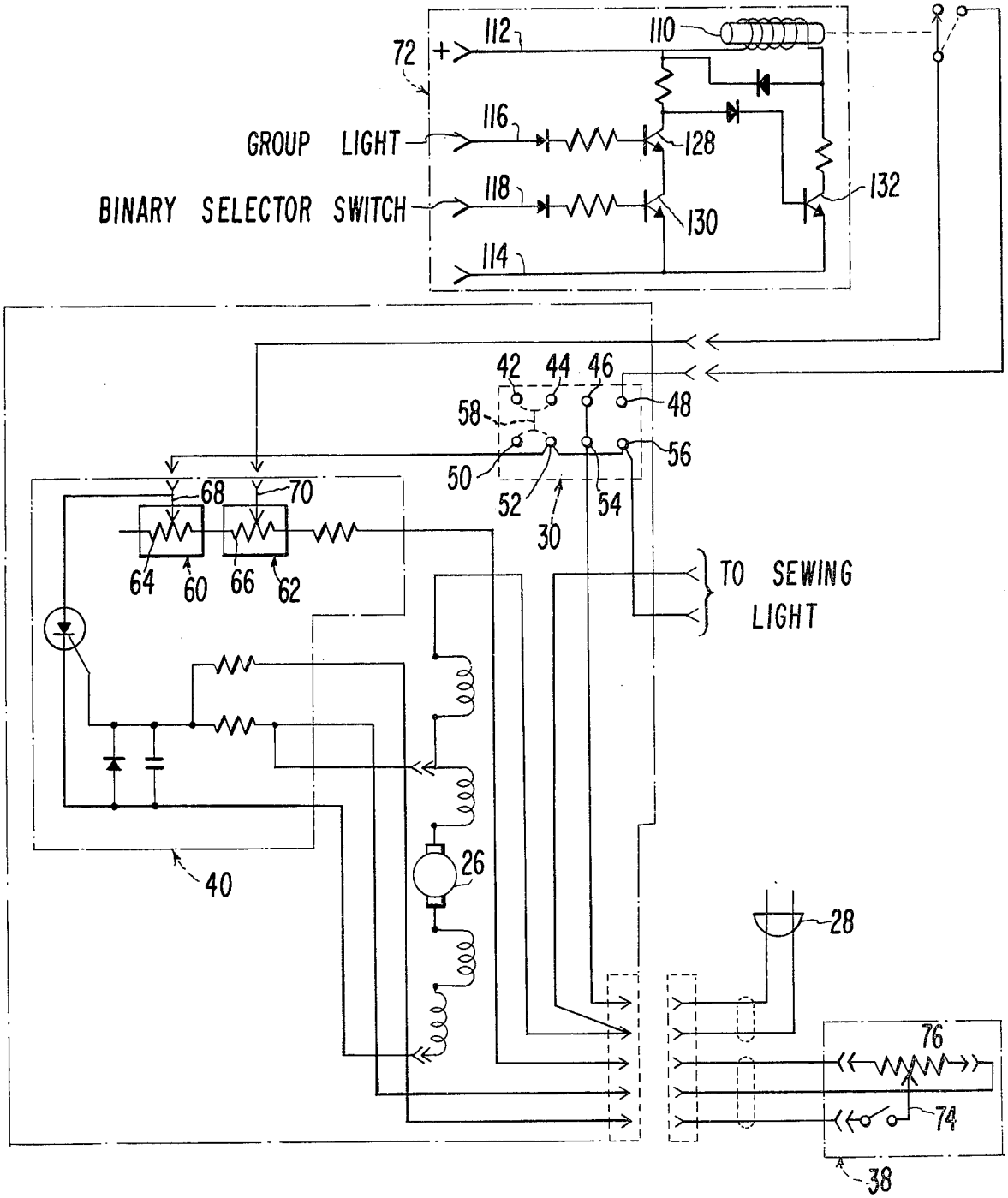
FIG. 2 is an electronic schematic diagram of a sewing machine motor speed control circuit having the teachings of this invention applied thereto.

The sewing machine has a bed 12 and a standard 14 which rises from the bed 12 and supports a bracket arm 16 which overhangs the bed 12. A sewing head 18 is carried at one extremity of the arm 16. Journalled within the sewing head 18 for endwise reciprocatory motion toward and away from the bed 12 is a needle bar 20 to which a thread carrying needle 22 is fastened with a clamp 24. An electric motor, shown schematically at 26 in FIG. 2 is contained within the standard 14 and drives stitch forming instrumentalities which include the needle bar 20 and a work feeding mechanism such as a feed dog (not shown) in a manner which is well known in the art.

Power is supplied to the sewing machine through an AC cord 28 which is connected to a three position slide switch 30 and which may be mechanically actuated by a three position pivotally mounted rocker 32 which is fastened to a slide bar 34 through a lever arm 36. Selection of the speed at which the motor 26 operates is controlled by a remote foot controller 38 which operates in conjunction with a motor control module which is shown generally at 40 in FIG. 2, and which is described in detail in U.S. Pat. No. 4,098,201 which issued to Suchsland et al on July 4, 1978, the rights to which are owned by the assignee of this application and which is incorporated herein by reference.

The switch 30 permits the sewing machine to be connected to a source of AC power and the selection of a high speed or a slow speed motor operating range. FIG. 2 shows that the switch 30 has two sets of terminals, 42, 44, 46 and 48 and 50, 52, 54 and 56 and a sliding wiper 58 for connecting any two adjacent terminals in each set to each other.

The two motor speed ranges are controlled by two potentiometers 60 and 62, which are a part of the motor control module 40. The potentiometer 60 has a resistive element 64 which is connected in series to a resistive element 66 contained within the potentiometer 62. The potentiometer 60 constitutes a slow speed adjustment and the potentiometer 62 constitutes a high speed adjustment. The potentiometer 60 has a wiper 68 which is connected to terminal 52 of the switch 30 and the potentiometer 62 has a wiper 70 which may be selectively connected to terminal 48 of the switch 30 through the operation of a motor speed limiting circuit which is shown generally at 72 in FIG. 2.

The motor speed limiting circuit 72 provides a means for automatically limiting the maximum speed of the motor to the slow speed range by selectively exciting the motor control module 40 through the wiper 70 of the potentiometer 62 when high speed range of the motor is permissible, and through the wiper 68 of the potentiometer 60 when it is desirable to have a reduced maximum motor speed. The speed at which the motor will operate within either the high speed or slow speed range is determined by the operator influenced position of a wiper 74 of a potentiometer 76 which is contained within the foot controller 38.

FIG. 1 also shows that located on the front of the bracket arm 16 are a group of momentary contact pushbuttons 78, 80, 82, 84, 86 and 88, any one of which may be depressed by the sewing machine operator to select a group of four stitches which may be sewn. Preferably a group light 90, 92, 94, 96, 98 or 100 corresponding to the pushbutton 78, 80, 82, 84, 86 or 88 will illuminate to indicate which group of stitches has been selected. A four position binary selector switch 102 may be manipulated by the operator to select a specific stitch pattern from the selected group of four stitches to be sewn. An example of a sewing machine pattern selection system which may be employed to select a particular stitch pattern is contained in U.S. Pat. No. 3,913,506 which issued on Oct. 31, 1975 to Adams et al which is assigned to the assignee of the presently disclosed invention, and which is incorporated herein by reference.

Figure 3:
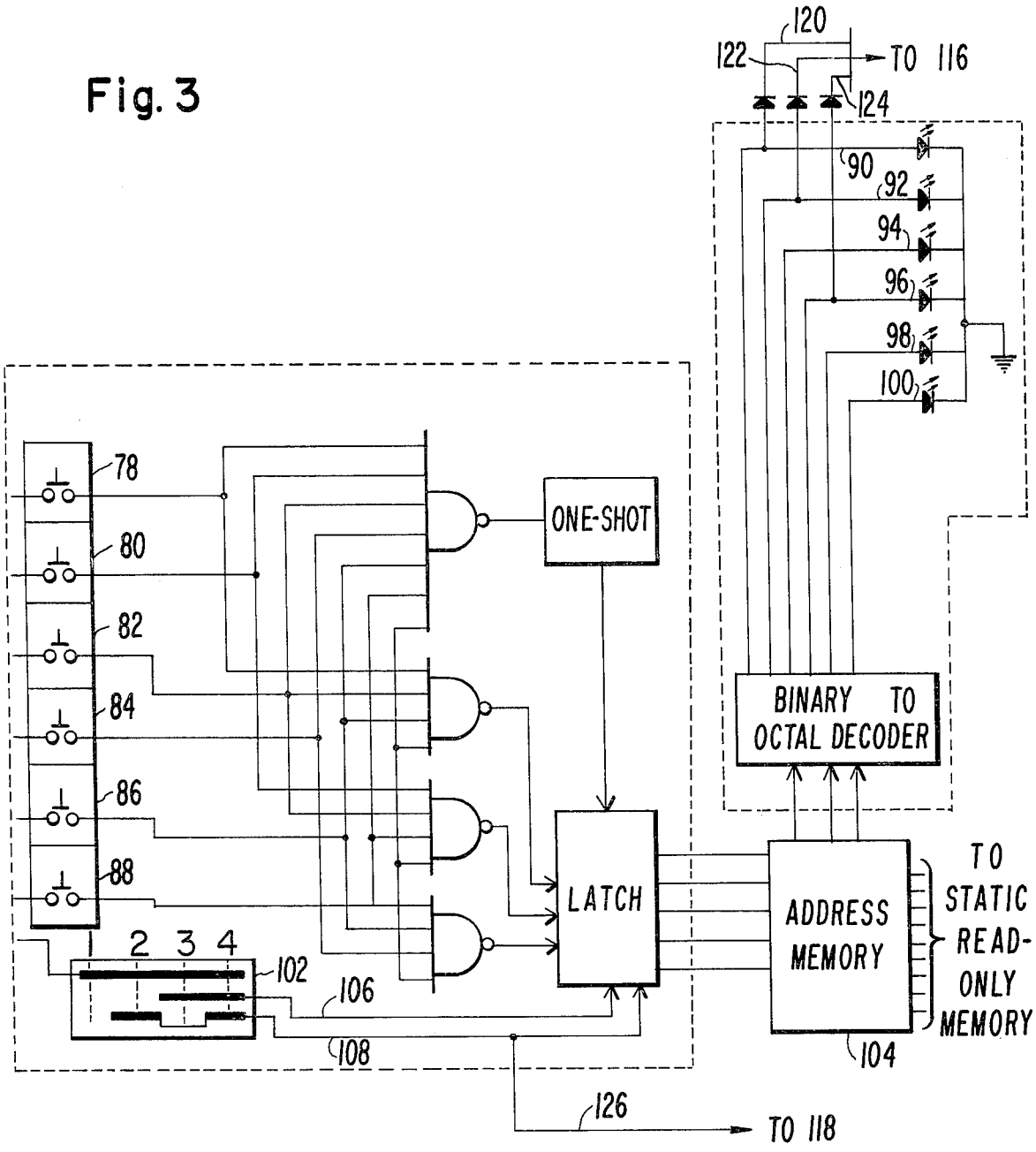
FIG. 3 is a circuit diagram of a pattern selection system which may be used to provide signals to activate the motor speed limiting circuit of this invention.

The aforementioned U.S. patent to Adams describes a system in which an operator influenced switching arrangement is provided for selecting from a plurality of preprogrammed stitch patterns in which the stitch pattern information is stored in a static read-only-memory. The system, a circuit diagram of which is shown in FIG. 3, includes a plurality of pushbutton switches such as those indicated in FIG. 1 at 78, 80, 82, 84, 86 and 88 and a slide switch such as the four position binary selector switch 102 of FIG. 3 each of whose two outputs are in binary format (0 or 1). The stitch pattern retrieved from the static read-only-memory (not shown) is selected by a binary address contained within an address memory 104 which is accessed by a combination of the state of the output of lines 106 and 108 of the binary selector switch 102 and the pushbutton switches 78, 80, 82, 84, 86 and 88. As more particularly described in the Adams patent, the operation of any one of the aforementioned pushbutton switches will influence the operation of the corresponding group light 90, 92, 94, 96, 98, or 100 which are preferably arranged vertically above their respective pushbutton switches to identify which pushbutton is effective at any time, and therefore it will be appreciated that the combination of the state of the group lights 90, 92, 94, 96, 98 and 100 and the state of the output of lines 106 and 108 of the binary selector switch 102 form a means which may be used for sensing which stitch pattern has been selected from the static read-only-memory.

The motor speed limiting circuit 72 includes a means for determining whether speed limiting is necessary and constitutes an AND logic circuit and a means for selecting the slow speed range of the motor, which is preferably shown as a relay 110 which is controlled by the AND circuit to switch the motor control module 40 to low speed when designated inputs are applied to the circuit 72. The circuit 72 is supplied with a source of DC voltage through the terminals 112 and 114. It will be appreciated that only certain groups of stitches will require slow speed stitching to be effective and may be grouped together for selection by depression of one or more of the pushbuttons 78, 80, 82, 84, 86 or 88. Similarly the construction of the binary selector switch 102 permits the designation of one or more of its positions to indicate a requirement for slow speed for stitches designated by those positions.

The designation of stitches requiring a slow stitching speed is achieved by applying signals from the lines used to control one or more of the group lights 90, 92, 94, 96, 98 or 100 to a terminal 116 of the speed limiting circuit 72 and by applying signals from the line 106 or the line 108 of the binary selector switch 102 to a terminal 118 of the speed limiting circuit 72. The combination of signals from one of the lines used to control group lights 90, 92, 94, 96, 98 or 100 and from the line 106 or the line 108 of the binary selector switch 102 comprise a means for sensing the selected stitch patterns which may be used to designate stitch patterns requiring speed limiting from those patterns not requiring speed limiting. FIG. 3 shows for illustrative purposes, lines 120, 122 and 124 connected to the group lights 90, 92 and 96. When one of the pushbuttons 78, 80 or 84 is depressed, the corresponding group light 90, 92 or 96 will be turned on and the line 120, 122 or 124 connected to the group light will carry a signal. The lines 120, 122 and 124 are connected to the terminal 116 of the motor speed control circuit and consequently the terminal 116 will receive a signal when stitch groups corresponding to the pushbuttons 78, 80 or 84 are selected. The output line 108 of the binary selector switch 102 is connected to the terminal 118 by a line 126. When stitches are selected by placing the binary selector switch 102 in a position in which the line 126 carries a signal, as for example, when the switch 102 is in position 2 or 4 as shown in FIG. 3, the terminal 118 of the motor speed control circuit 72 will be made positive. The presence of a signal on terminal 116 from one of the lines 120, 122 or 124 will cause a transistor 128 to conduct and the presence of a signal on the terminal 118 from the line 126 of the binary selector switch 102 will cause a transistor 130 to conduct. When transistors 128 and 130 are both conducting, a transistor 132 will not conduct, which will cause the normally energized relay 110 to open which will disconnect the terminal 48 of the slide switch 30 from the wiper 70 of the potentiometer 62, thereby effectively limiting the motor speed to the slow speed range irrespective of the position of the wiper 58 of the switch 30. The motor speed may still be controlled by the operator by use of the foot controller 38, however, the maximum speed which the motor will achieve will be limited by the setting of the potentiometer 60 and will be independent of the high speed setting of the sliding wiper 58 on the slide switch 30. It is to be understood that the speed limiting circuit 72 will have no effect if the slide switch 30 is in the slow speed position.

Figure 4:
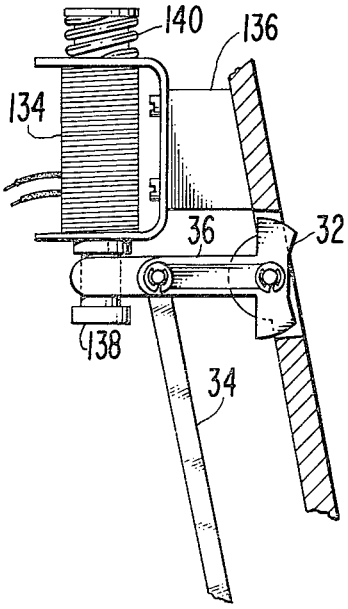
FIG. 4 is a perspective view of a solenoid which may mechanically actuate a motor speed selector switch.

FIG. 4 shows an alternate embodiment of the arrangement shown in FIG. 1 in which the relay 110 may be used to actuate the motor speed selector switch 26 to change the position thereof in response to signals from the motor speed limiting circuit 72. A solenoid 134 is mounted to a bracket 136 which is fastened to the bracket arm 14. A plunger 138 of the solenoid 134 is connected to the lever arm 36 and may influence the position of the switch 30 through the slide bar 34. When the motor speed limiting circuit 72 energizes the relay 110, power is supplied to the solenoid 134 causing the plunger 138 to pull the lever 36 and the slide bar upwardly thereby moving the speed selector switch into the slow speed position. When the motor speed limiting circuit is deenergized, the switch 30 will remain in the slow speed position until it is moved to either the off or high speed position by the sewing machine operator. The switch 30 may still be set manually through the rocker 32, to select a motor speed and turn the sewing machine on and off, independent of the influence of the solenoid 134 on the position of the rocker 32.

Numerous alterations of the structure herein disclosed will suggest themselves to those skilled in the art in light of the above teachings. For example, it is entirely feasible to have more than two motor speed ranges which are selectively controlled by selection of a stitch pattern by increasing the number of motor speed control potentiometers and increasing the number of inputs to the AND logic circuit 72. However, it is to be understood that the present disclosure relates to a preferred embodiment which is for the purpose of illustration only, and not to be construed as a limitation of the invention. All such modifications which do not depart from the spirit of the invention are intended to be included within the scope of the appended claims.

We claim:

1. In a zig-zag sewing machine having stitch forming instrumentalities, including a thread carrying needle and a work feeding mechanism, a motor for driving said stitch forming instrumentalities, electronic means for selectively controlling said stitch forming instrumentalities in accordance with preprogrammed stitch patterns, and a motor speed control having at least a high speed range and a slow speed range, a switch for selecting between said high speed range and said slow speed range, means for automatically limiting the maximum speed of said sewing machine motor to said slow speed range with certain of said selected stitch patterns comprising:

means for sensing the selected stitch pattern;

means for determining whether speed limiting is necessary, and means for selecting said slow speed range.

2. The sewing machine arrangement as set forth in claim 1 wherein said means for determining whether speed limiting is necessary comprises an electronic AND logic circuit having means for sensing the selected stitch pattern.

3. The sewing machine arrangement as set forth in claim 1 wherein said means for sensing the selected stitch pattern includes means for sensing the state of a plurality of group lights and means for sensing the position of a binary selector switch.

4. The sewing machine arrangement as set forth in claim 1 wherein said means for selecting said slow speed range is a relay operated by said AND electronic logic circuit.

5. The sewing machine arrangement as set forth in claim 1 wherein said means for selecting said slow speed range is a solenoid actuated by said means for determining whether said speed limiting is necessary, said solenoid operating said switch for selecting between said high speed range and said slow speed range.

* * * * *